US007513646B2

(12) United States Patent
Catone et al.

(10) Patent No.: US 7,513,646 B2
(45) Date of Patent: Apr. 7, 2009

(54) LUMINAIRE OPTICAL SYSTEM

(75) Inventors: Robert Catone, St. Louis, MO (US); Robert Kloepple, St. Louis, MO (US); Dan Skillington, St. Charles, MO (US)

(73) Assignee: JJI Lighting Group, Inc., Greenwich, CT (US)

( * ) Notice: Subject to any disclaimer, the term of this patent is extended or adjusted under 35 U.S.C. 154(b) by 159 days.

(21) Appl. No.: 11/675,830

(22) Filed: Feb. 16, 2007

(65) Prior Publication Data

US 2008/0198596 A1 Aug. 21, 2008

(51) Int. Cl.
*F21S 13/14* (2006.01)

(52) U.S. Cl. ..... 362/252; 362/216; 362/247; 362/260; 362/405

(58) Field of Classification Search ..... 362/216, 362/217, 221, 225, 240, 247, 249, 252, 265, 362/260, 245, 404, 405, 406
See application file for complete search history.

(56) References Cited

U.S. PATENT DOCUMENTS

| | | | |
|---|---|---|---|
| 305,200 | A | 9/1884 | Klein, Jr. |
| 1,022,878 | A | 4/1912 | Ryan |
| 1,160,859 | A | 11/1915 | Dale |
| 1,257,496 | A | 2/1918 | Lamb |
| 1,349,478 | A | 8/1920 | Sugimura |
| 1,484,978 | A | 2/1924 | Wheeler |
| 1,552,121 | A | 9/1925 | Dau |
| 1,654,243 | A | 12/1927 | Eckschlager |
| 1,889,567 | A | 11/1932 | Persons |
| 1,927,897 | A | 9/1933 | Moser |
| 2,093,165 | A | 9/1937 | Flood, Jr. |
| 2,107,028 | A | 2/1938 | Doane |
| 2,794,431 | A | 3/1940 | O'neil |
| 2,262,586 | A | 11/1941 | James |
| 2,323,172 | A | 6/1943 | Whittaker |
| 2,408,669 | A | 10/1946 | Mattson |
| 2,976,399 | A | 3/1961 | Christy |
| 3,141,620 | A | 7/1964 | Guggemos |
| 3,521,120 | A | 7/1970 | Anderson |
| 3,551,736 | A | 12/1970 | Doehner |
| 3,643,088 | A | 2/1972 | Osteen et al. |
| 3,735,329 | A | 5/1973 | Funabashi et al. |
| 3,777,138 | A | 12/1973 | Metzler |
| 4,004,144 | A | 1/1977 | Chako |
| 4,173,730 | A | 11/1979 | Young et al. |
| 4,219,869 | A | 8/1980 | Bowman et al. |
| 4,347,460 | A | 8/1982 | Latassa et al. |
| 4,361,992 | A | 12/1982 | Rapp |

(Continued)

FOREIGN PATENT DOCUMENTS

| | | |
|---|---|---|
| AT | 101574 | 6/1925 |

(Continued)

*Primary Examiner*—Stephen F Husar
(74) *Attorney, Agent, or Firm*—James E. Cole; Middleton Reutlinger

(57) ABSTRACT

A luminaire optical system comprises a ballast housing, a reflector having an upper end and a lower end, the ballast housing connected to the reflector, a plurality of lamp assemblies each having a base and a lamp portion, the lamp in electrical communication with the base at a single end, the base disposed downward and radially outward of said lamp.

34 Claims, 10 Drawing Sheets

U.S. PATENT DOCUMENTS

| | | | | |
|---|---|---|---|---|
| 4,367,417 | A | | 1/1983 | Casasanta |
| 4,520,436 | A | | 5/1985 | McNair et al. |
| 4,595,969 | A | | 6/1986 | McNair |
| 4,651,257 | A | | 3/1987 | Gehly |
| 4,704,664 | A | | 11/1987 | McNair |
| 4,802,073 | A | | 1/1989 | Plumly |
| 4,890,200 | A | | 12/1989 | Mandy |
| 4,922,393 | A | | 5/1990 | McNair |
| 4,956,758 | A | | 9/1990 | Aubrey et al. |
| 5,067,064 | A | | 11/1991 | Gehly et al. |
| 5,197,798 | A | * | 3/1993 | Tickner ..... 362/260 |
| 5,355,290 | A | | 10/1994 | Tickner |
| 5,377,086 | A | | 12/1994 | Tickner |
| 5,523,931 | A | | 6/1996 | Kassay et al. |
| 5,528,473 | A | | 6/1996 | Kassay et al. |
| 5,672,932 | A | | 9/1997 | Goldman |
| RE36,414 | E | | 11/1999 | Tickner |
| D431,316 | S | | 9/2000 | Tickner |
| 6,905,226 | B2 | | 6/2005 | Tickner et al. |

FOREIGN PATENT DOCUMENTS

| | | |
|---|---|---|
| AT | 168010 | 9/1950 |
| AT | 135146 | 4/1958 |
| CH | 322476 | 6/1957 |
| DE | 710827 | 8/1941 |
| DE | 846383 | 6/1952 |
| DE | 945777 | 6/1956 |
| EP | 0344627 | 12/1989 |
| FR | 537370 | 5/1922 |
| FR | 580397 | 11/1924 |
| FR | 977356 | 3/1951 |
| FR | 1085180 | 1/1955 |
| FR | 1109705 | 2/1956 |
| GB | 878534 | 10/1961 |
| GB | 116066 | 6/1968 |
| GB | 2248293 | 4/1992 |
| JP | 4075204 | 3/1992 |
| WO | 89/12780 | 12/1989 |

* cited by examiner

LUMINAIRE OPTICAL SYSTEM

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC

None.

BACKGROUND OF THE INVENTION

High intensity discharge lamps (HID) lamps are widely used in various structures having high ceilings such as gymnasiums, warehouses, commercial buildings and the like. HID lamps typically utilize metal halide, mercury vapor, high or low pressure sodium depending on the application and lighting characteristics desired. These lamps may range from 500 to 1,000 Watts for example, so that the buildings wherein such HID lamps are utilized are well lit. However, one problem with such HID lamps is the significant energy consumption occurring in these lamps.

In order to maximize downward lighting, bell-shaped reflectors are typically utilized to fit over the base of the HID lamps. The lamps are screwed into a power supply in order to power the lamp. The reflectors are typically made of polished aluminum or similarly reflective lightweight material. The opposite lower end of the reflector may be opened or may be covered with a translucent lens to further diffuse lighting emanating from the lamp and provide a substantially attractive appearance.

As an alternative to HID lamps, some commercial applications utilize fluorescent light fixtures, which often have fluorescent tubes with a length of four or eight feet. These tubes are often placed parallel to the floor or substrate to produce a predetermined lumination pattern. Installation and replacement of these types of tubes, particularly eight foot tubes, is often difficult due to the length of the tubes and the electrical connectors being located at distal ends of the tube.

Compact fluorescent lamps have a generally "folded-over" bi-axial design which attached to a light fixture at a single end. Alternatively, such lamps may be helical or corkscrew in nature. Sales of compact fluorescent lamps (CFLs) have increased in volume due to improvements in the performance and reduction of prices in this type of lamp. In addition, the market for CFLs has been spurred on by the integration of lamp and electronic ballast with either a screw-in or bayonet fitting allowing easy replacement of consumable lamp.

The CFLs are produced in various shades of white including "warm white" or "soft white" providing a light very similar to an incandescent bulb; "white", "bright white" or "medium white" producing a yellowish white light, whiter than an incandescent lamp but still on the warm side; "cool white" emitting more of a pure white tone; and "day light" having a slightly bluish white appearance. Compact fluorescent lamps have two main parts. First, the CFLs utilizes a gas filled tube. Second, the CFLs typically utilize magnetic or electronic ballast. The ballast may be remote from the tube or may be connected to the tube. Electrical energy in the form of an electrical current passes from the ballast through the gas causing it to emit ultraviolet light. The ultraviolet light excites a white phosphorus coating on the inside of the tube emitting a visible light.

Prior art low-bay luminaires utilize compact fluorescent lamps generally in a base up orientation and tilted inside the reflector to extend downwardly from the base. There are several problems with prior art luminaires of this type. First, in the prior art, base-up configurations, the lamp sockets are closely spaced near the top of the reflector creating excessive heat. Accordingly, various prior art luminaires are only rated for 25 degrees Celsius ambient operating temperature. Second, there is always a desire to increase the total lumen output, the sum of light output from nadir to 180° of the luminaire. There is also a desire to increase the total efficiency of the luminaire, which is measured as a percentage of the lamp output by the luminaire. There is also a desire to decrease the amount of uplight emitted from the luminaires since such uplight is only useful with very high reflectant ceilings. Further, there is a desire to decrease the amount of lighting in the glare zone which is defined as the 60 to 90 degree area. There is also a desire to increase the light in the useful zone defined as the 0 to 60 degree area.

Given the foregoing, it will be appreciated that a luminaire optical system is needed which provides lower operating temperature and therefore increased life, high total output and efficiency, increased useful light and decreased glare.

SUMMARY

A low-bay luminaire comprises a reflector having a first smaller opening at an upper end and a second larger opening at a lower end, a ballast housing disposed above the smaller opening, a stem extending from near the ballast housing downward and radially outward, a socket disposed near a radially outward end of the stem, a compact fluorescent lamp having a base for electrical connection at a single end, the compact fluorescent lamp configured in a base down diagonal orientation wherein the lamp extends from the base upwardly toward the lamp center. The low-bay luminaire further comprises a reflector plate disposed within the reflector. The stems are connected to the reflector plate. The low-bay luminaire further comprises a ballast within the ballast housing. The low-bay luminaire further comprises wiring between the ballast and the socket. The reflector is bell-shaped. The low-bay luminaire further comprising a wire-grid extending across said second lower opening. The low-bay luminaire further comprises a lens disposed over the second larger opening at the lower end. The lens is connected to the reflector along a lower edge of the reflector and an upper edge of the lens. The lens is integrally formed with the reflector. The low-bay luminaire further comprises a wire-grid extending over the lens. The lamp extends diagonally upward and radially inward. The lamp is rotated at an angle from a radially extending axis.

A luminaire comprises an upper enclosure portion, a reflector connected to the upper enclosure portion, a stem extending radially outwardly and downwardly within the reflector, a socket connected to the stem, a lamp assembly connected to the socket, the assembly having a base and a lamp, the base positioned radially outwardly and downwardly so that the lamp extends upwardly and radially inwardly from the base. The luminaire the reflector being acrylic. The reflector being polished aluminum. The lamp is angled at a range of about 20 to 30 degrees from a horizontal plane. The lamp having electrical connection at a single end.

A luminaire optical system comprises a ballast housing, a reflector having an upper end and a lower end, the ballast housing connected to the reflector, a plurality of lamp assemblies each having a base and a lamp portion, the lamp in electrical communication with the base at a single end, the base disposed downward and radially outward of the lamp. The luminaire optical system further comprises a stem extending downward and radially outward to a lowermost end of the lamp assembly. The luminaire optical system further comprises a socket positioned at a lower end of the stem. The lamp assembly is connected to the socket. The lamp assemblies being rotated from radially extending reference axes.

A luminaire optical system comprises a reflector having a plurality of lamp assemblies arranged therein, a lamp assemblies spaced apart circumferentially, the lamp assemblies having a base and a lamp extending from the base, a socket in electrical communication with each of the lamp assemblies, the map assembly having a base down arrangement such that the lamp extends upwardly and inwardly within the lamp. The luminaire optical system further comprises a ballast housing connected to the reflector. The luminaire optical system further comprises a reflector plate within the reflector and a plurality of stems depending from the reflector plate. The sockets receive the lamp assemblies. The stems extend downwardly and radially outward. The luminaire optical system further comprises a ballast plate disposed within the ballast housing. The lamp assemblies having a single electrical connection at one end of the assembly. The lamp assemblies extending upwardly toward the reflector plate.

A luminaire optical system comprises a ballast housing connected to a reflector, a reflector plate positioned in an upper portion of the reflector, a plurality of stems extending downward and radially outward from the reflector plate, a plurality of lamp assemblies having a single electrical connection, the lamp assemblies connected to a lower end of the stems and extending upwardly an radially inward toward the reflector plate. The ballast housing having at least one upper vent aperture and at least one lower vent aperture. The lamp assemblies being circumferentially spaced apart.

BRIEF DESCRIPTION OF THE DRAWINGS

The above-mentioned and other features and advantages of this Luminaire Optical System, and the manner of attaining them, will become more apparent and the invention will be better understood by reference to the following description of embodiments of the system taken in conjunction with the accompanying drawings, wherein.

DETAILED DESCRIPTION

Figure 1:
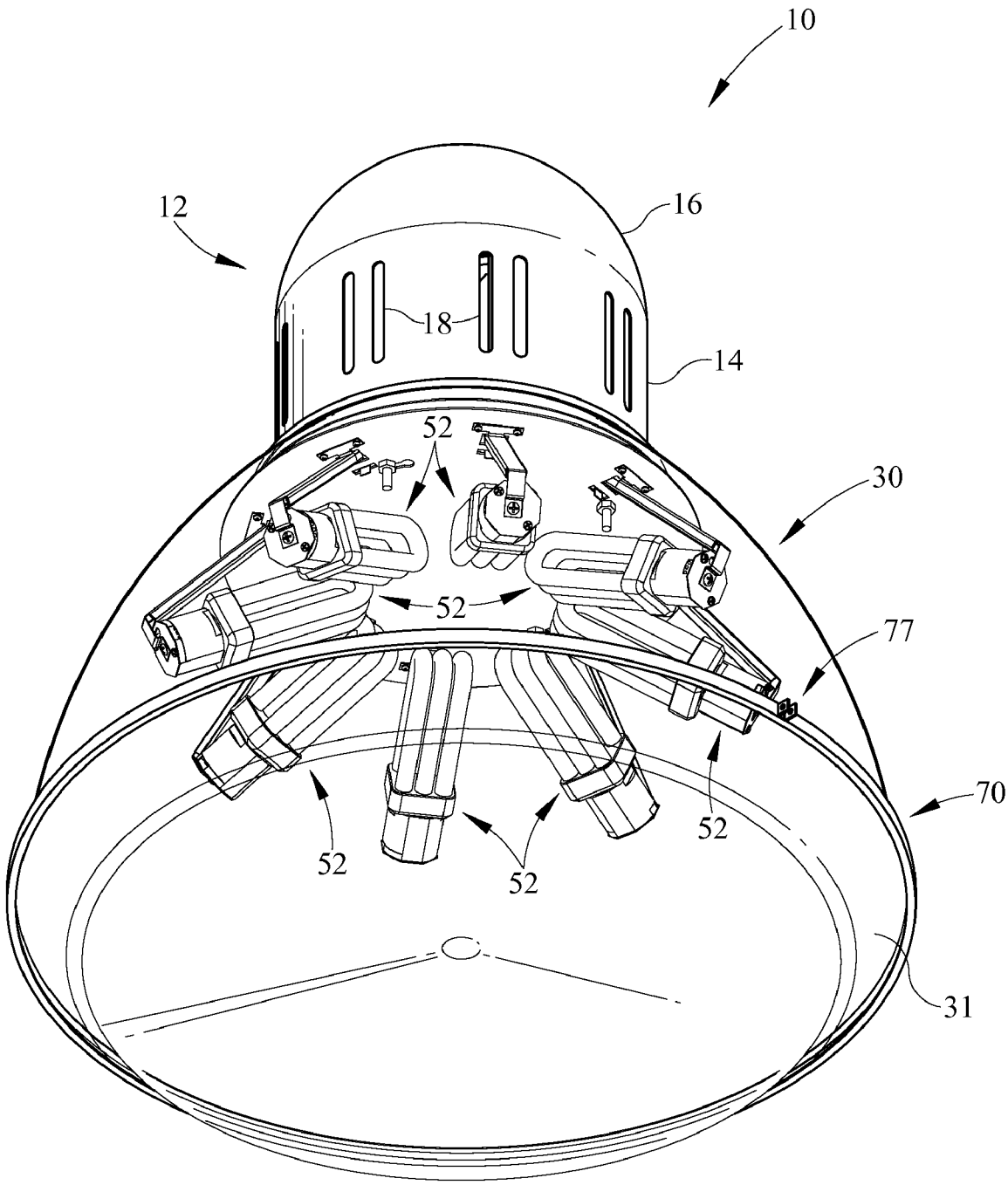
FIG. 1 depicts a perspective view of the luminaire optical system.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings. The term reflector as used herein is meant to include both reflective surfaces, refractive surfaces, or a combination of the two, which both reflect and refract light. The term useful light zone means light in the range of 0-60 degrees from nadir and is measured in Lumens. The term glare zone means light in the range of 60-90 degrees from nadir and is measured in Lumens. The term uplight means light in the range of 90-180 degrees from nadir and is measured in Lumens. The term total efficiency represents a percentage of the total lamp output produced from the uplight, glare and useful light output.

Referring now in detail to the drawings, wherein like numerals indicate like elements throughout the several views, there are shown in FIGS. 1-10 various aspects of a luminaire optical system. Specifically, various embodiments are depicted of a luminaire optical system having a base down inwardly extending lamp orientation. Such reverse tilt of the lamps places the socket and lamp base, the hottest luminaire components, away from the ballast which is susceptible to heat effects. Such configuration also improves optical characteristics by providing high total efficiency, decreased up light, decreased glare, increased useful light while allowing cooler operation of the lamp resulting in a use within a higher ambient temperature area.

Figure 2:
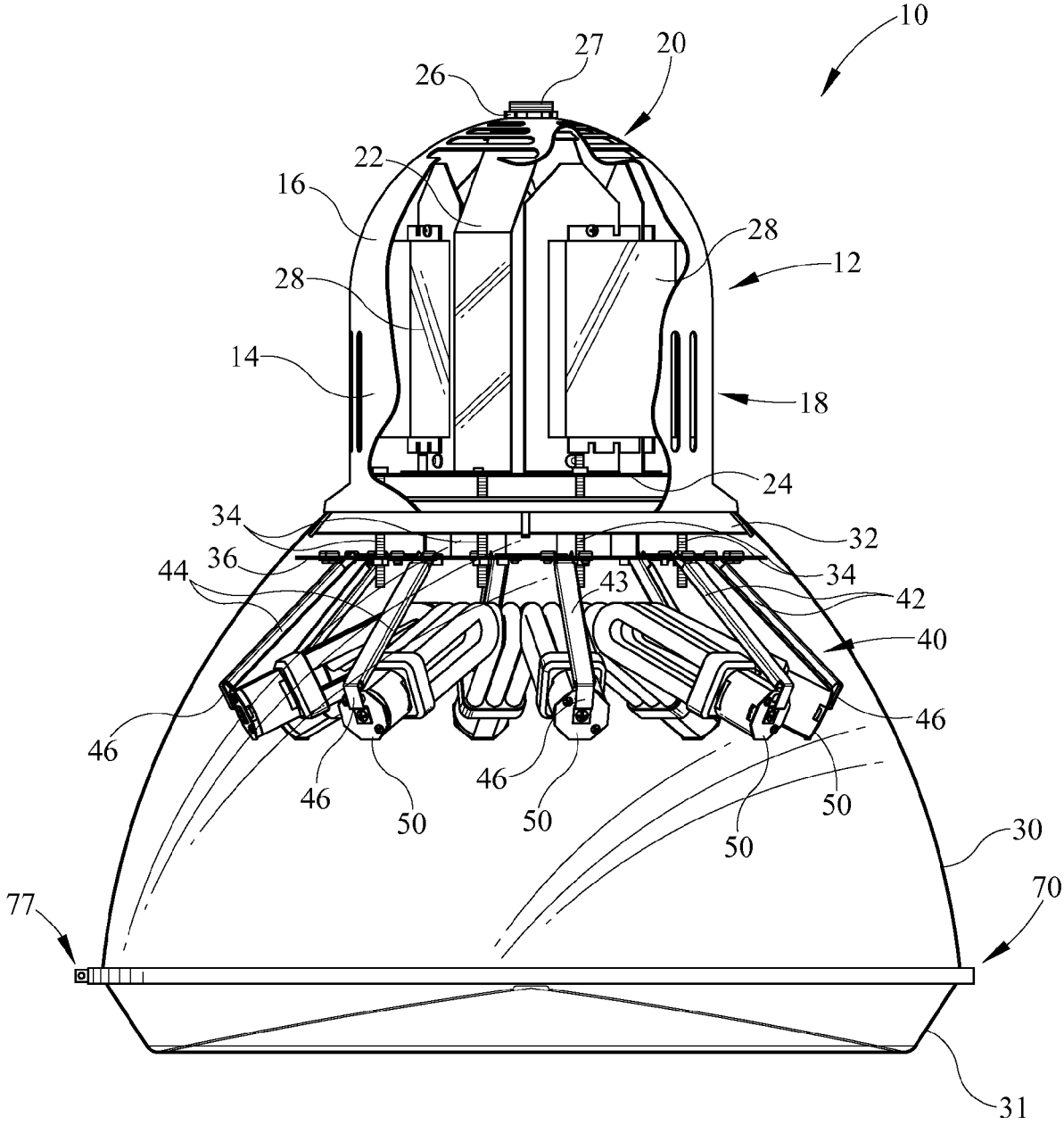
FIG. 2 depicts a side view of the luminaire optical system of FIG. 1.

Referring initially to FIGS. 1 and 2, perspective and side views, respectively, of the luminaire optical system 10 of the present embodiment are depicted. An upper portion of the luminaire optical system 10 has a ballast housing 12 defined by a substantially cylindrical lower housing portion 14 and a generally hemispherical upper portion 16. Although specific shapes are described, this is not a necessity as various alternative shapes may be utilized to form the ballast housing 12. The ballast housing 12 further comprises a plurality of lower vent apertures 18 disposed along the lower housing portion 14 as well as upper vent apertures 20 disposed on the upper housing portion 16. The upper and lower vent apertures 18, 20 allow the natural convection currents to draw cool air in through the lower apertures 18 and expel heat through the upper vent apertures 20. The vent apertures 18, 20 may be various shapes. The ballast housing 12 may be formed of various materials including impact resistant plastic, metal or other heat resistant materials. Further, the ballast housing 12 may include emergency backup circuitry and an uninterruptible power supply if desirable.

Referring still to FIGS. 1 and 2, beneath the ballast housing 12 a reflector 30 is depicted. The reflector 30 is generally shown as transparent for ease of showing the components therein. The reflector 30 is substantially bell-shaped having a lower opening of a first larger diameter and an upper opening of a second smaller diameter. Alternatively, the reflector 30 may be flared, for example, frusto-conical in shape. At the larger second diameter, a lens 31 may be utilized with the luminaire optical system 10. Within the upper opening of the reflector 30 is a reflector top 32 which is received from the inside portion of the reflector 30 and connected to the ballast plate 24 by a plurality of fasteners. According to this construction, the upper rim of the reflector 30 is captured between the ballast plate 24 and lower housing portion 14 on an upper side and the reflector top 32 from the inside lower portion of the reflector 30. The reflector top 32 is generally conical in shape and therefore complimentary of the curvature of the upper portion of the reflector 30. The reflector top 32 may further comprise clips 33 (FIG. 3) depending from a lower surface thereof. The clips 33 may be fastened to the reflector plate 32 or may be integrally formed therewith.

Figure 3:
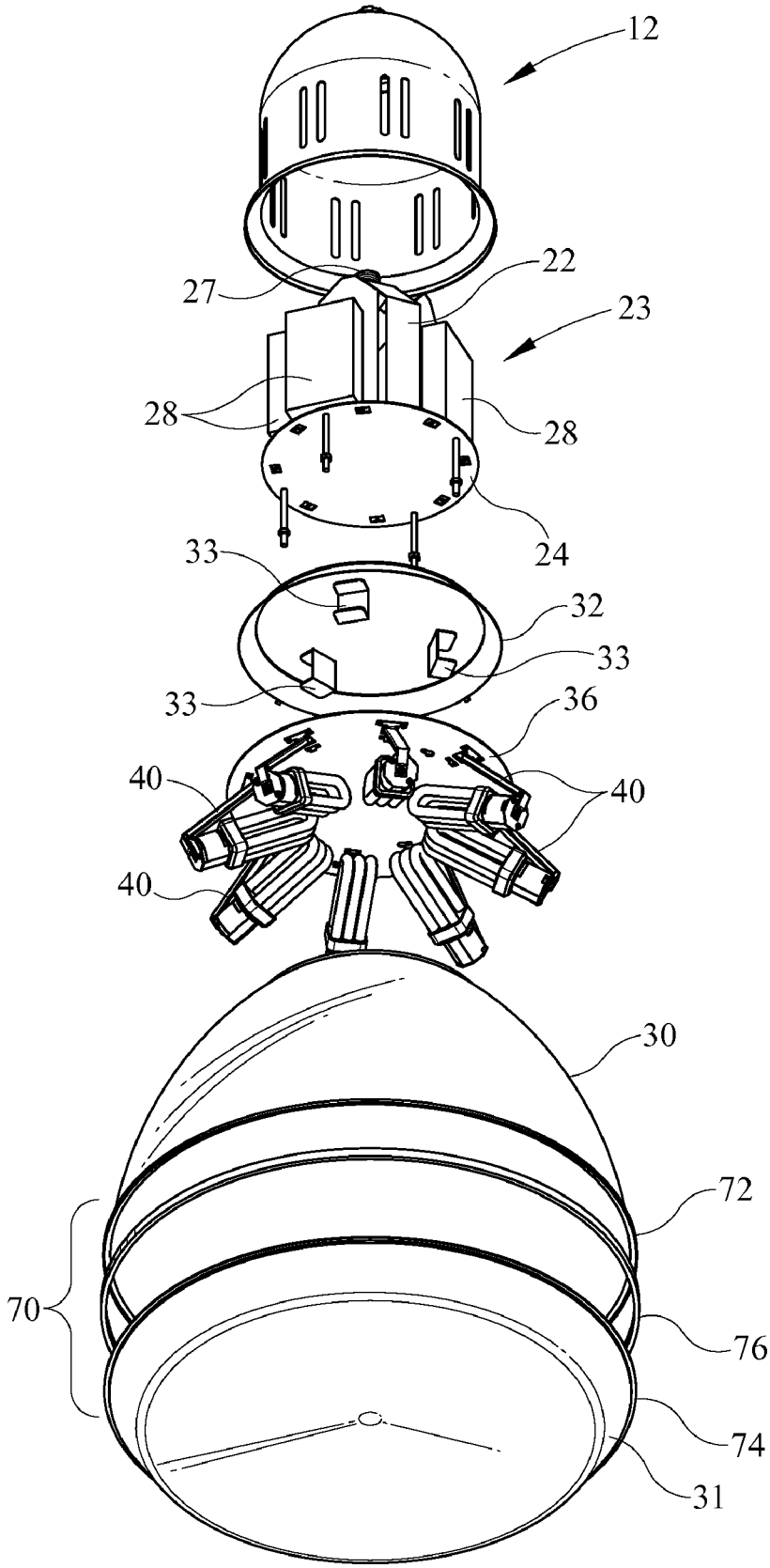
FIG. 3 depicts an exploded perspective view of the luminaire optical system of FIG. 1.

Referring now to FIG. 3, an exploded view of the luminaire optical system 10 is depicted. Within the ballast housing 12, is a ballast cartridge 23. The ballast cartridge 23 includes a ballast plate 24 and at least one ballast 28 mounted to the ballast plate 24. The at least one ballast 28 of the depicted embodiment shows four ballasts 28 spaced apart by about ninety degrees. The number of ballasts will be dependent on the number of lamps utilized in the luminaire optical system, as will be understood by one skilled in the art. In the present embodiment, the ballast plate 24 is generally circular in shape. The ballast plate 24 may be various shapes which fit within or adjust to the ballast housing 12.

Within the interior of the ballast housing 12 are a plurality of ballasts 28. The electronic lamp ballasts 28 use electronic circuitry to provide proper starting and operating electrical condition to power one or more fluorescent lamps 56. Specifically, the ballasts 28 control the current moving through a lamp 56 and each of the ballasts 28 may control one or more lamps 56. Electronic ballasts typically change the frequency of the power from the standard mains frequency to 20,000 Hertz or higher in order to eliminate flicker associated with fluorescent lighting. As a result, fluorescent lamps operate at a higher efficiency. Because of the high frequency of operation, the electronic ballasts are generally smaller, lighter and more efficient and therefore run cooler than line frequency magnetic ballasts. In addition, the vents 18, 20 allow removal of heat from ballasts 28 from the ballast housing 12. The present luminaire optical system 10 may be used with either electronic or magnetic ballasts.

As previously indicated, the ballasts 28 may control one or more lamps. The ballasts 28 may also have a dimming function by opening circuits to selected lamps, thereby illuminating only selected lamps to provide the dimming function. Alternatively, the ballasts 28 may be dimming ballasts which provides dimming function to each lamp.

Also located within the interior portion of the ballast housing 12 and extending from the ballast plate 24 is at least one strap 22. The strap 22 is substantially U-shaped extending upwardly from opposed sides of the ballast plate 24 and centrally located within near the upper portion of the ballast housing 12. The strap 22 generally provides structural support for the ballast housing 12 and connects the ballast housing 12 to the ballast plate 24. The strap 22 may be other shapes providing structural rigidity may be utilized.

A threaded rod 27 extends upwardly through the central portion of the upper housing portion 16 and through strap 22. A nut or washer assembly 26 captures the housing 12 on the rod 27 and against the reflector 30.

Depending from the ballast plate 24 is a plurality of fasteners or bolts 34 which are connected to a reflector plate 36. Specifically, the embodiment depicts that the fasteners 34 depend from the ballast plate 36, through the reflector top 32 and through the reflector plate 36. Each of the fasteners 34 has a nut located adjacent a lower end thereof. The nuts retain the reflector plate 36 on the fasteners 34 depending from the ballast plate 24. However, other means may be utilized for suspending the reflector plate 36 within the reflector 30 such as brazing, welding or riveting the plate 36 to posts depending from the ballast plate 24. The reflector plate 36 is defined by a pre-selected diameter and is made of a reflective material such as polished aluminum or other reflective material. In addition, lower ends of the clips 33 (FIG. 3) may also be fastened to the reflector plate 36 to support the reflector plate 36 from above. The reflector plate 36 is of a diameter which extends to the inner surface of the reflector 30 at a given elevation within the reflector 30 to inhibit light passing upwardly beyond the reflector plate 36. Thus, the light is reflected downwardly through the lower opening portion of the reflector 30 or outwardly through the reflector 30.

Depending from the reflector plate 36 are a plurality of equidistantly spaced stems or arms 40. The stems 40 are fastened to the reflector plate 36 and extend diagonally downwardly and radially outward from the plate 36. The stems or arms 40 may be integrally formed with the plate 36 or alternatively may be fastened or otherwise connected to the reflector plate 36 by various means other than the fasteners indicated. The stems 40 may be formed of various materials which may or may not be reflective. Each of the stems 40 are generally U-shaped in cross-section with a first side portion 42, a spine 43 and an opposite side portion 44 which provide rigidity to the stem 40 and inhibit bending due to the heat and weight of the lamp 56. Alternative stem shapes may be utilized in order to support an array of lamp assemblies 52 therefrom.

At an end of each of the stems 40, opposite the reflector plate 36, is a socket 50. The socket 50 is connected to the end or finger 46 of the stem 40. The socket 50 is generally cylindrical in shape but may be various alternative shapes which receive a lamp assembly 52 described further herein. The socket 50 may receive a threaded base portion or the socket 50 may receive a push-type bayonet attachment in order to provide electrical communication between the lamp assemblies 52 and the ballasts 28. The lamp assemblies 52 of the present luminaire system 10 have a single electrical connection at one end, for a single connection to socket 50. The stems 40 are generally arranged in a circular pattern so that the lamp assemblies 52 are also generally circular in configuration.

Figure 4:
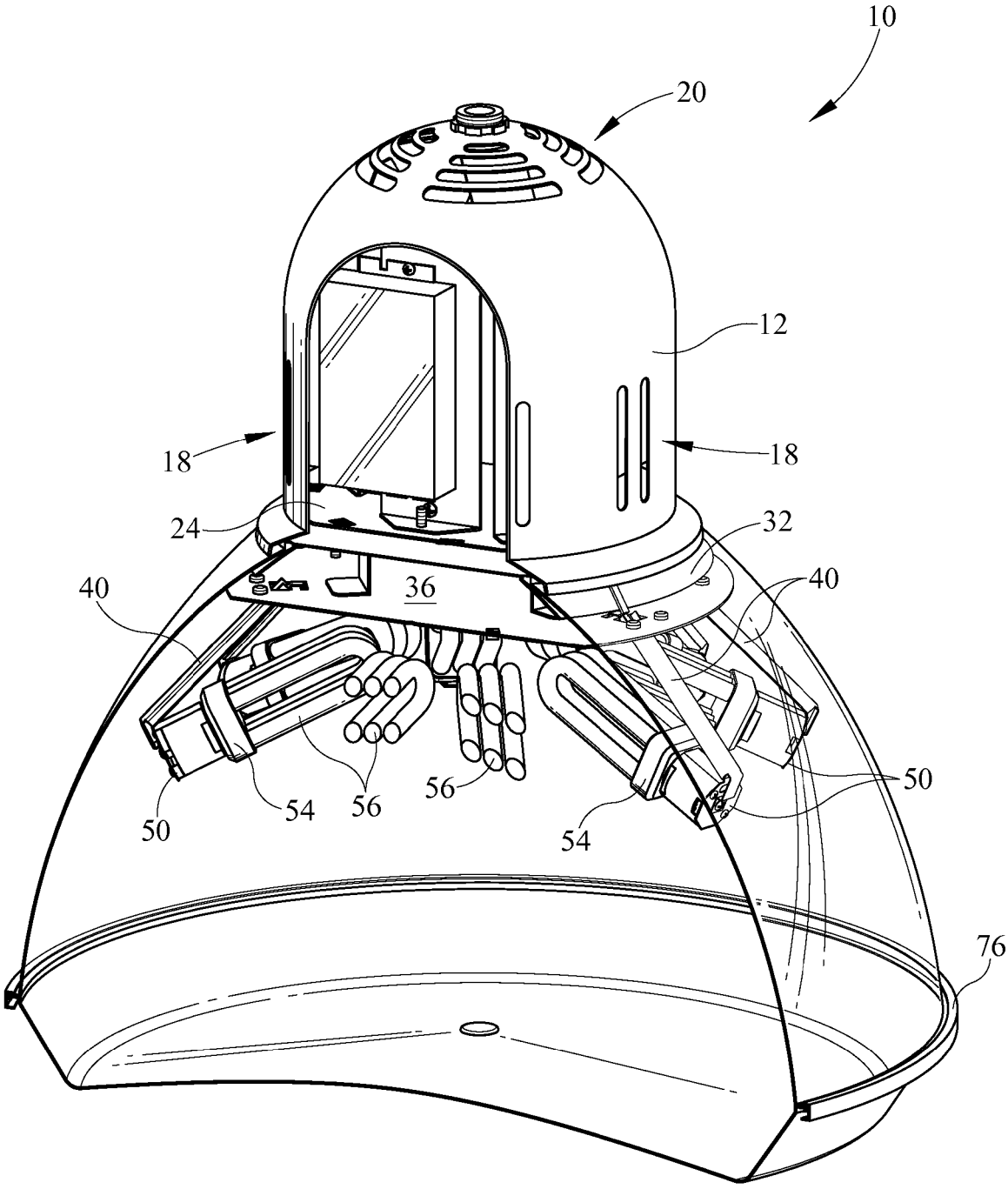
FIG. 4 depicts a cutaway perspective of the luminaire optical system of FIG. 1.

Referring now to FIG. 4, a cutaway perspective view depicts the assembled luminaire optical system 10. Each socket 50 and lamp assembly 52 extends from a stem 40. Each lamp assembly 52 comprises a base 54 and lamp 56. The base 54 is generally square shaped but may comprise alternative shapes. Each assembly 52 further comprises a plurality of U-shaped or bi-axial lamp tubes 56 connected to the base 54. The lamps 56 are compact fluorescent lamps and may vary from the bi-axial design to, for example, corkscrew. The compact fluorescent lamps 56 are gas discharge lamps that use electricity to excite a gas such as mercury vapor in argon, resulting in plasma that produces a shortwave ultraviolet light. This ultraviolet light causes a phosphor to fluoresce, producing a visible light. In order to operate the compact fluorescent lamp correctly, the ballast regulates the current flow through the lamps 56.

Fluorescent lamps are more efficient than incandescent bulbs of an equivalent brightness because more of the consumed energy is converted to useable light and less is converted to heat, allowing fluorescent lamps to run cooler. For example, an incandescent lamp may only convert ten percent (10%) of its power input to visible light whereas a fluorescent lamp producing the same amount of useful visible light energy may only require one-third to one-quarter as much electricity input. Further, typically a fluorescent lamp will last between ten and twenty times as long as the equivalent incandescent lamp.

In the embodiment depicted the lamps 56 are compact fluorescent lamps. For example, 8 lamps consuming 42 Watts (8-42 Watts) each may be utilized wherein each lamp has an output of about 3,200 Lumens. In another example, there may be 4-57 Watts lamps utilized in the luminaire 10 wherein each lamp 56 has an output of 4,300 Lumens. In yet another example, there may be 4-70 Watts lamps utilized wherein each lamp 56 has an output of 5,200 Lumens. Greater wattages may be utilized such as 60 Watts, 70 Watts, or 85 Watts lamps. It is also within the scope of this invention that a three lamp arrangement be utilized wherein the each lamp is, by way of example, 120 Watts with an output of about 9,000 Lumens.

Wiring (not shown) from the ballast 28 extends through the ballast plate 24, through the reflector top 32 and through the reflector top 36. Once the wiring is through the reflector top 36, the wiring may extend along the inside of each stem 40 to the socket 50. Due to the channel shape of the stems 40, each stem acts as a wiring tray or conduit and hides the wiring from casual view of an observer near the light.

Figure 5:
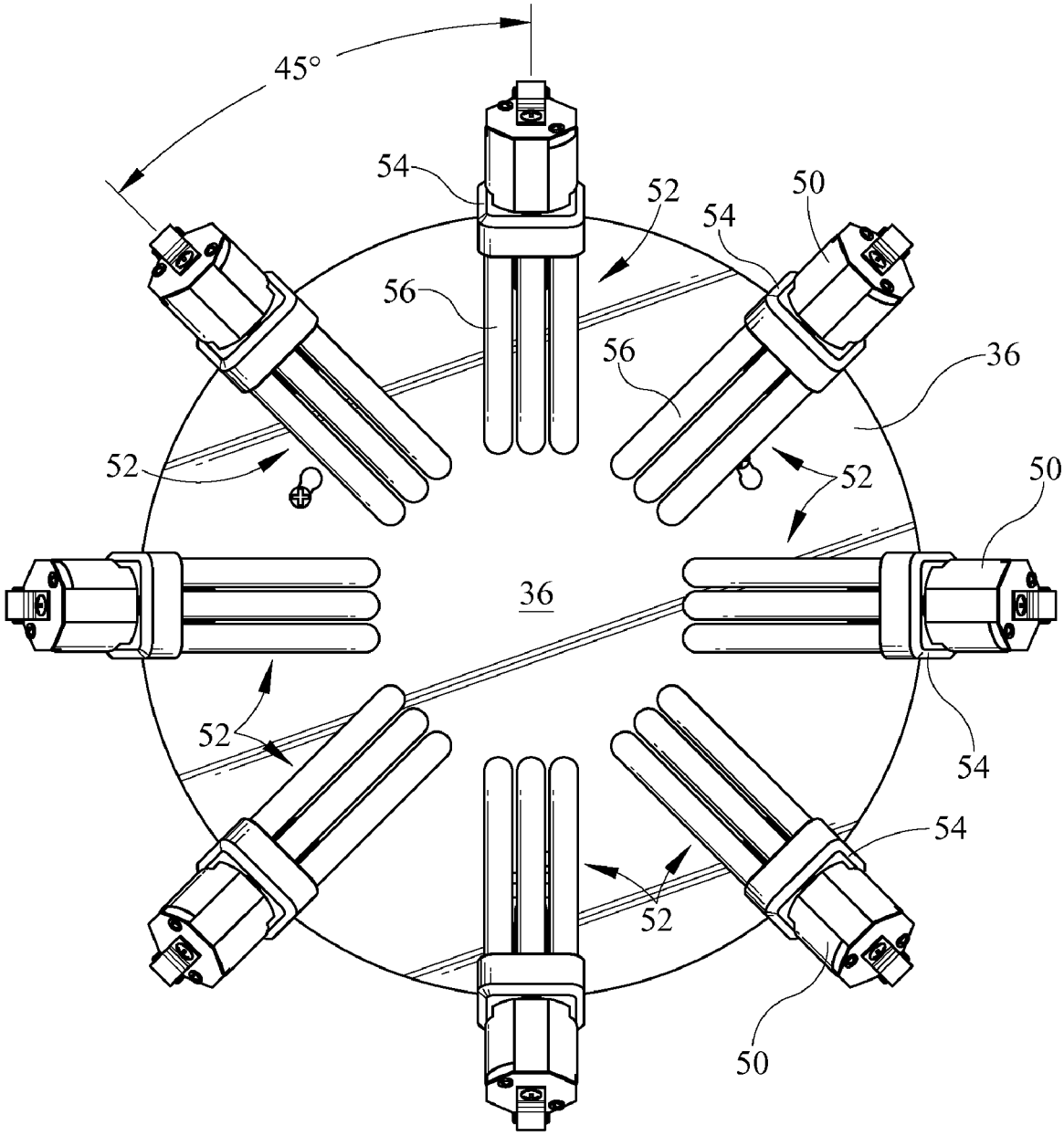
FIG. 5 depicts a bottom view of one embodiment of the lamp assembly configuration.

Referring now to FIG. 5, a bottom view of the luminaire optical system with the reflector 30 removed. Depending from the reflector plate 36 are each of the lamp assemblies 52. The stems 40 (FIG. 4) extending between the reflector plate 36 and lamp assemblies 52 are hidden by the lamp assemblies 52. The lamp assemblies 52 are each spaced apart about the reflector plate by an angle of about 45 degrees. Although eight lamp assemblies are depicted, other alternative numbers of lamp assemblies 52 may be utilized having various alternative degrees of spacing with the present luminaire optical system 10.

Figure 6:
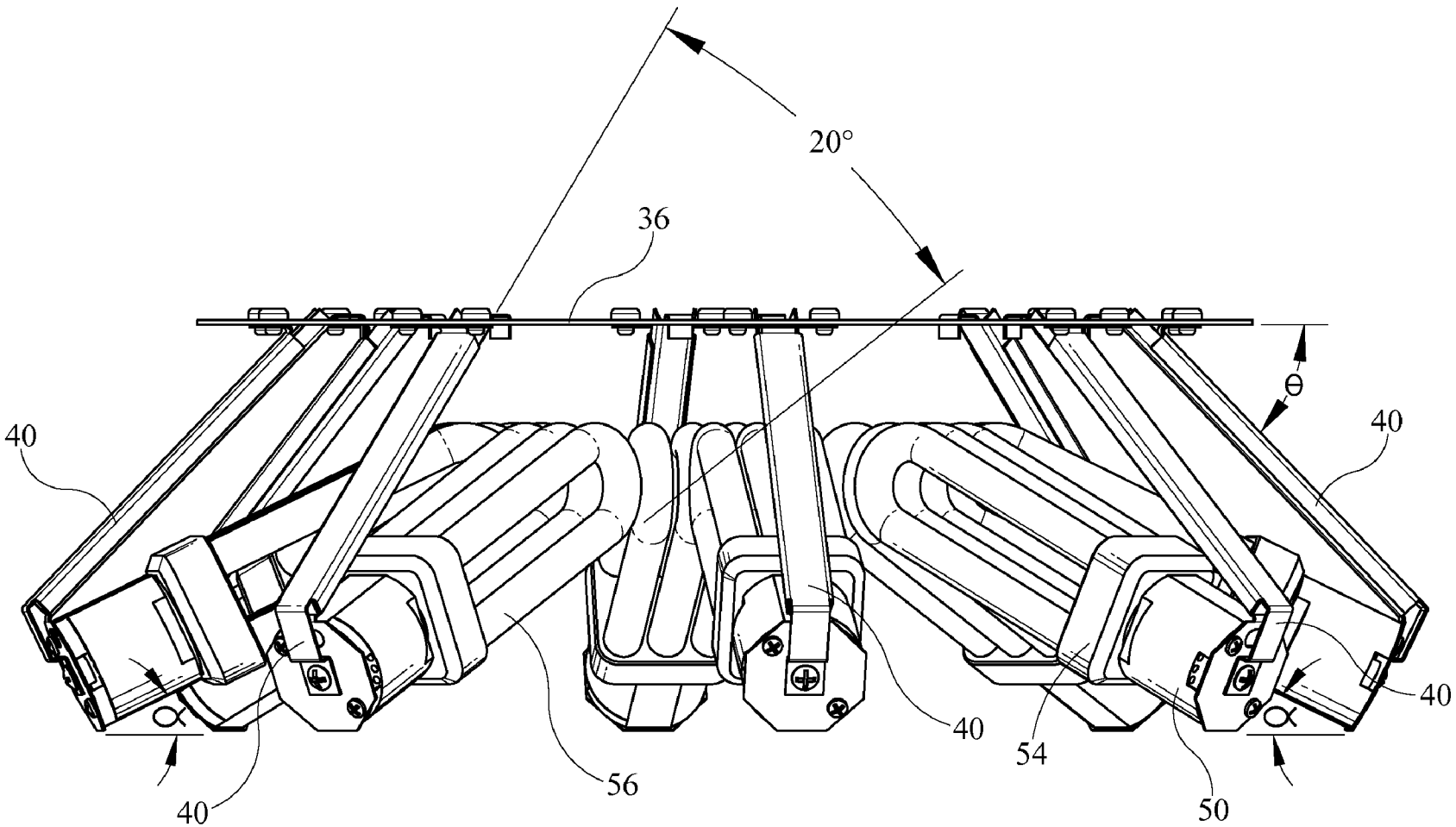
FIG. 6 depicts a side view of the reflector plate and lamp assemblies with the reflector and ballast housing removed.

Referring now to FIG. 6, a side view of the reflector plate 36 and lamp assemblies 52 are depicted removed from the reflector 30. FIG. 6, as well as other views previously described, depict the lamp assemblies 52 tilted such that the base 54 is positioned downwardly and outwardly within the reflector 30. The stems 40 are each extending at an angle from the horizontal reflector plate 36. The stems 40 are positioned at an angle $\theta$ to the horizontal plate 36. The angle $\theta$ may be between about 40 degrees and 50 degrees from the plate 36. According to the embodiment depicted, the angle $\theta$ may be about 45 degrees. The socket 50 and lamp assembly 52 provide that the lamp 56 is tilted at an angle $\alpha$ relative to a horizontal. The angle $\alpha$ may be between about 20 and 30 degrees. The depicted embodiment represents an angle $\alpha$ of about 25 degrees. Thus, according to the depicted embodiment, the lamp 56 of each assembly 52 is shown at a 20 degree tilt from the stem 40.

Each of the sockets 50 are positioned in a downward orientation away from the reflector plate 36 so that the lamps 56 extends upwardly at the predetermined angle toward the center of the reflector plate 36. This base down orientation, i.e. base 54 is spaced radially outward and downward from the lamp 56, provides greater spacing between the sockets 50 and the bases 54 where large amounts of heat are created. It further spaces the sockets 50 and bases 54 away from the ballast housing 12 so that the ballasts 28 therein are not exposed to the direct heat of the sockets 50 and bases 54. In addition, it has been found that the arrangement of lamp assemblies 52 in the base down, diagonally upward extending configuration provide other advantages including a high level of total efficiency, decrease in uplight measured in the 90 to 180 degree range, decrease in the glare zone, which is measured in the 60 to 90 degree range and an increase in the useful zone measured in the 0 to 60 degree range. Further, because the lamps extend radially inward and upward from the sockets 50, the heat generated by the lamps is also spaced from the reflector 30 which may be plastic and susceptible to high heat deterioration.

The following tables indicate the advantages of the luminaire optical system 10. Table 1 indicated that the instant invention increases useful light, reduces glare and reduces uplight as compared to prior art competitive luminaires. In this example, Applicant's luminaire is compared to the prior art competitor luminaires of a competitor. The testing was performed with eight lamps having an output of 25,600 Lumens. Applicant's luminaire has a useful light output in the 0 to 60 degree range of 14,431 lumens which is greater than the two prior art outputs indicated. Accordingly, Applicant's Luminaire optical system 10 has a 27% advantage over

TABLE 1

| | Zone | Guth Lumens | Prior art A | Advantage over A | Prior art B | Advantage over B |
|---|---|---|---|---|---|---|
| Useful Light | 0-60° | 14,431 | 11,341 | 27% more | 10,248 | 41% more |
| Glare | 60-90° | 2525 | 4103 | 39% less glare | 3294 | 23% less glare |
| Uplight | 90-180° | 3001 | 5616 | 10% less | 3931 | 3% less |

Prior art product A and 41% advantage over prior art product B. Applicant's luminaire also has decreased glare, light in the range of 60-90 degrees. Applicant's luminaire has a glare output of 2525 Lumens in the range of 60 to 90 degrees. To the contrary the prior art luminaires have respective glare outputs of 4103 and 3294. Such measurements represent a 39% decrease and 23% decrease in glare respectively. This has an end result in less eye strain to those in the area of the luminaire 10. Finally, Applicant's luminaire has an output of 3001 lumens in the uplight range of 90 to 180 degrees. To the contrary, the prior art devices have outputs of 5626 and 3931 respectively. Accordingly, Applicant's invention represents a decrease in uplight of 10% and 3% respectively. Thus, Table 1 indicates the significant improvements in the luminaire optical system versus prior art devices due to the base down, upwardly and inwardly extending lamp assemblies 52 configuration.

Likewise, Table 2 is included to show the luminaire optical system operation of the present embodiment at increased ambient temperature. In the example, the ambient temperature is 40 degrees Celsius (104 degrees Fahrenheit) and the maximum allowable temperatures are shown next to the measured temperatures of the luminaire 10 components.

TABLE 2

| | Part | Maximum Temperature | Measured Temperature |
|---|---|---|---|
| A | Ballast housing (12) | 90° C. | 73.5° C. |
| B | Reflector Top 32 | 90° C. | 81° C. |
| C | Lamp Base 54 | 140° C. | 117° C. |
| D | Socket 50 | 130° C. | 88° C. |
| E | Reflector Wall 30 | 90° C. | 75° C. |
| F | Lens Wall 31 | 90° C. | 75° C. |

As shown in Table 2, the measured temperatures are less than the maximum allowable temperatures for operation at 40° C.

ambient temperature. Thus, Applicant's luminaire is operable in higher ambient temperatures than the prior art devices, which are certified for maximum ambient temperature of 25° C. The base down, upward and inwardly (reverse tilt) extending lamp configuration also provides spacing of the sources of largest amounts of heat for the luminaire 10. The location of the sockets 50 relative to the reflector 30 reduce the hotspots on the acrylic reflector 30 and lens 31. Accordingly, the system 10 will operate at higher ambient temperatures, within the maximum temperature rating (40 degrees Celsius) allowed for certification.

The luminaire optical system 10 has the further advantage of increasing ballast life up to 10 years. It is believed that a 10° C. decrease in operating temperature provides 50% increase in life at 40° C. ambient temperature.

The lumen output of the fixture may be improved by use of reflective materials for the components of the luminaire 10 within the reflector 30. For example, the stems 40 and bolts 34 may be formed of reflective materials or may have a reflective coating similar to the reflectance of polished aluminum.

Referring now to FIGS. 1-4, a lens 31 is shown attached to the lower edge of the reflector 30. The reflector 30 includes a rim 72 extending about lowermost edge of the reflector 30. The reflector rim 72 may be formed integrally with the reflector 30 or may be fastened to the reflector 30. Opposite the reflector rim 72 is the lens 31. The lens 31 may be formed of acrylic or polycarbonate material and has a generally frustoconical shape with a lowermost lens cover. The lens 31 generally allows light to pass through and may focus light depending on the desired light output characteristics. The upper edge of the lens 31 includes a rim 74 which generally corresponds in size and shape to the reflector rim 72. The rims 72 and 74 generally have the same diameter but may differ if such difference is compensated for by an attachment mechanism 76. The attachment mechanism or band 76 is generally C-shaped. The combination of the band 76 and rims 72, 74 define an assembly 70. The open side of the C-shaped band 76 slides over the rims 72 and 74 and compresses the rims 72 and 74. The band 76 may further comprise tabs 77 which are fastened together with a fastener (not shown) to retain the band 76 over the rims 72, 74 and provide compression force on the assembly 70.

Figure 7:
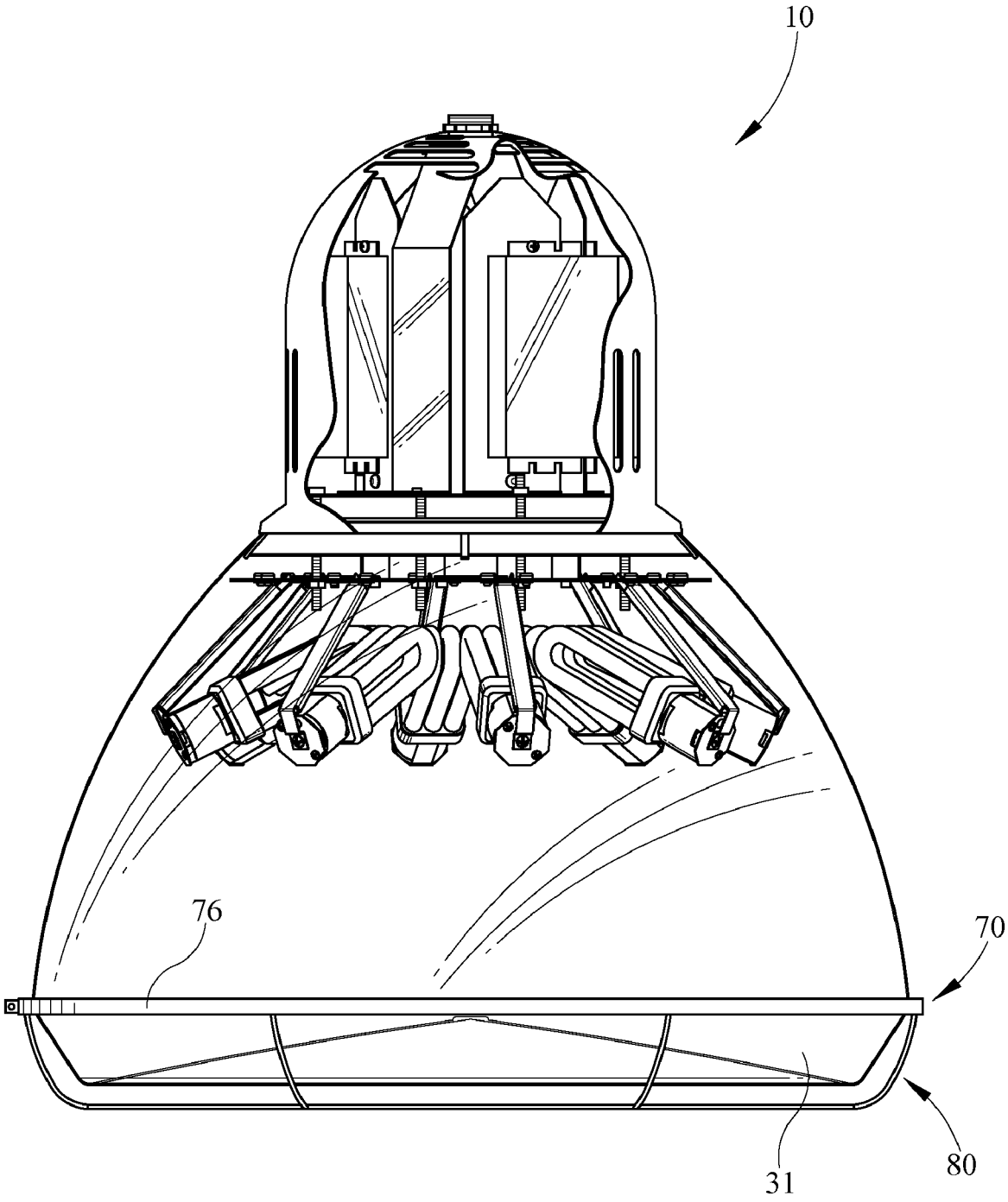
FIG. 7 depicts a side view of a luminaire with both a lower prismatic lens and wire guard.

Alternatively, the luminaire optical system 70 may further comprise a grill 80 connected to the rim 72 of the reflector 30. The grill 80 is shown in FIG. 7 connected to the assembly 70 including lens 31. However, one skilled in the art will realize that the lens 31 may be removed so that the grill 80 is connected by band 76 to the reflector rim 72. If the lens 31 is utilized as shown, the band 76 may need to be changed in size to accommodate the grill 80, and rims 72, 74. If the lens 31 is not utilized, a smaller band 76 may be utilized.

Figure 8:
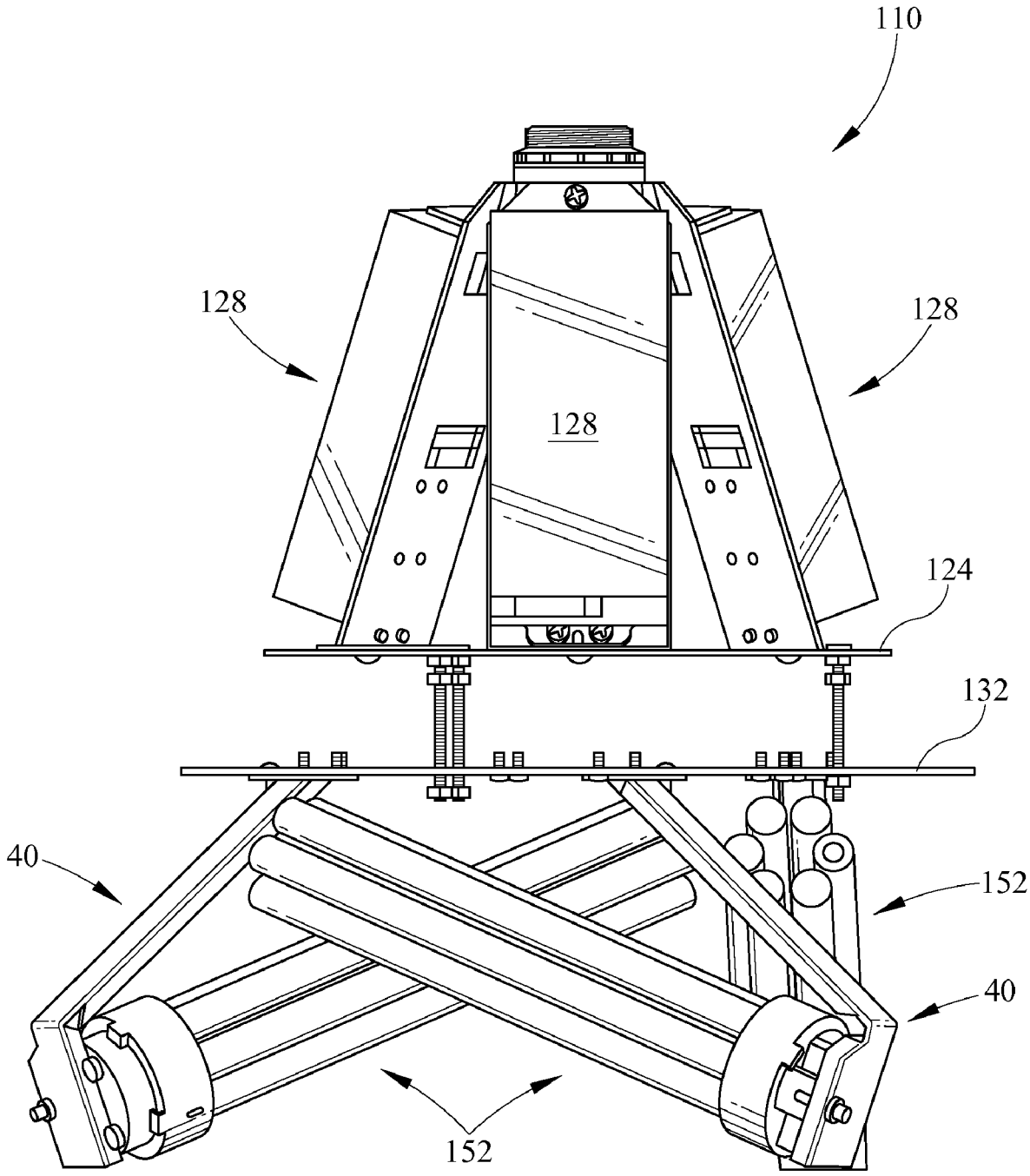
FIG. 8 depicts a side view of an alternative embodiment of a luminaire optical system.

Referring now to FIG. 8, a side view of an alternative embodiment of a luminaire optical system 110 is depicted. In the side view depicted, the ballast housing and lens are removed to clearly depict the internal components of the luminaire 110. The upper portion of the luminaire 110 includes three ballasts 128, one for each of the lamp assemblies 156. The ballasts 128 are connected to a ballast plate 124 which is substantially horizontal. The ballast plate 124 is parallel to and spaced from the reflector top 132. The plate 124 and reflector top 132 may be formed of various shapes but are depicted as circular (FIG. 9) in the present embodiment, which compliments the ballast housing (not shown) and shape of the lens (not shown).

Depending from the reflector top 132 are a plurality of stems 140. Three stems 140 depend from the lower surface of the reflector top 132. As previously described, the stems 140 depend from the reflector top 132 at an angle from a vertical axis. The stems 140 have an upper end attached to the reflector top 132 and a lower end connected to the lamp assembly 152.

Figure 9:
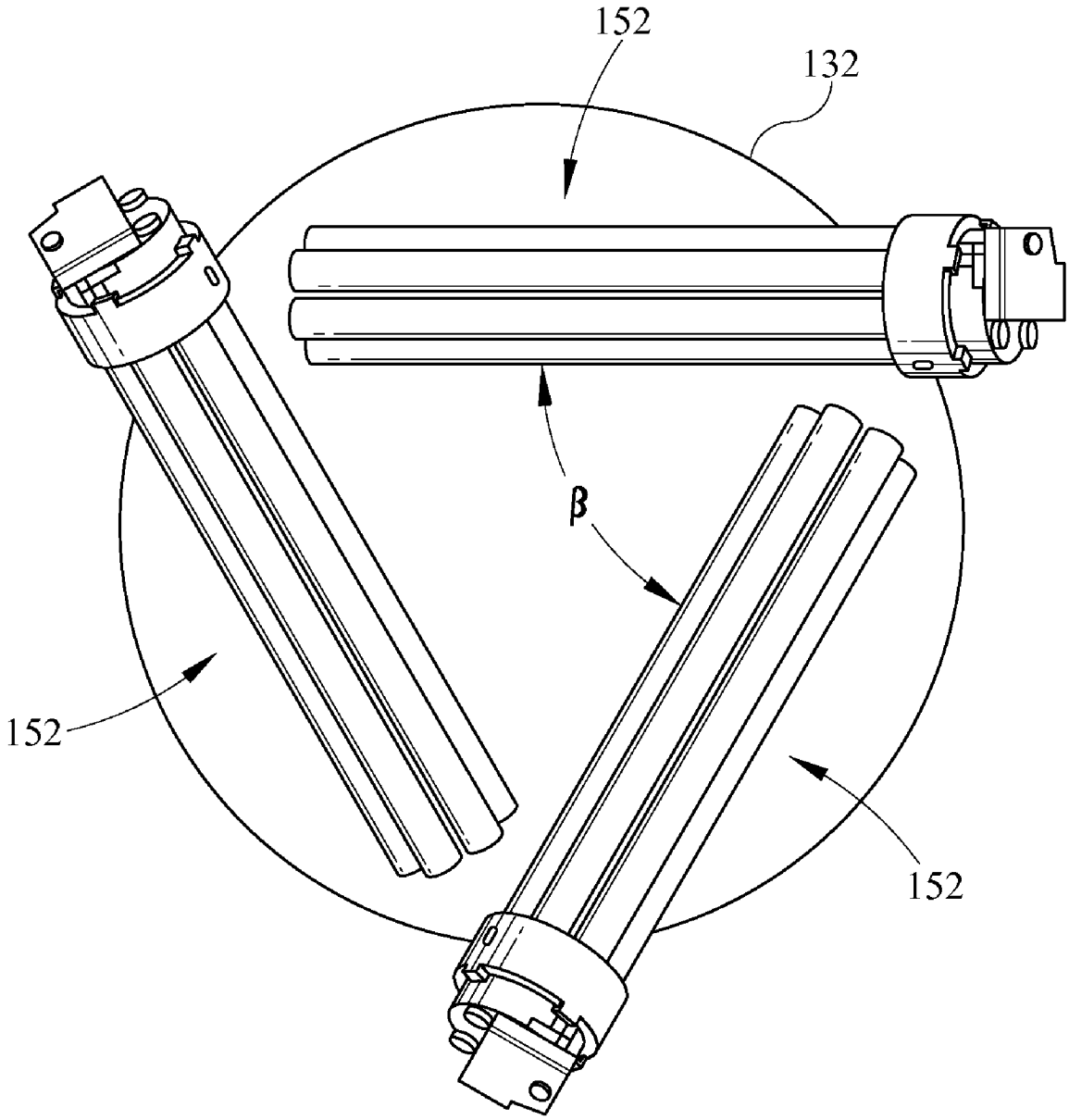
FIG. 9 depicts a bottom view of the embodiment of FIG. 8.

The lamp assemblies 152 are oriented in a base down reverse tilt configuration. In addition, as shown in FIGS. 8 and 9, the lamp assemblies 152 do not extend toward the center of the luminaire 110 as the previous embodiment. The stems 40 are not depicted as radially extending. Instead the stems 40 are rotated at an angle from radially outward extending axes. The angle may be about 30 degrees. An angle $\beta$ is measured from lamp to lamp in FIG. 9. The angle $\beta$ is about 60 degrees so that the three lamp assemblies 152 define a substantially triangular shape. However, the various numbers of lamp assemblies 152 may be utilized in alternative configurations from triangular. As depicted, the three lamp arrangement lamp assemblies 152 may comprise lamps having 120 Watts with an output of about 9,000 Lumens Since the stem 140 extends downwardly at an angle from a vertical axis, the alternative embodiment also utilizes a base down reverse tilt lamp assembly.

Figure 10:
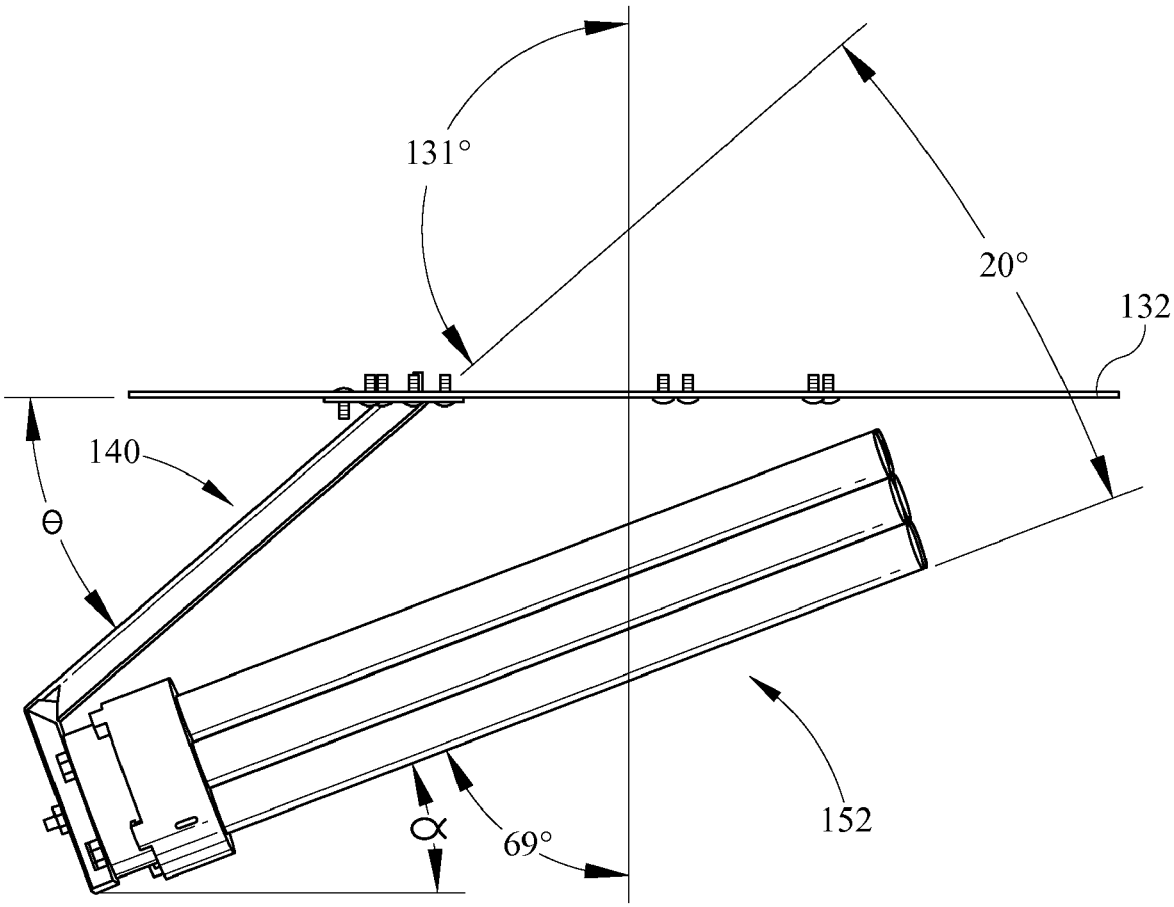
FIG. 10 depicts a side view of a lamp within the alternative luminaire optical system of FIG. 8.

Referring now to FIG. 10, a side view of a lamp assembly 152 is depicted. The reflector top and 132 and stem 140 are also shown depicting the lamp assembly 152 depicting therefrom. A reference vertical axis is depicted from which two angles are measured. An upper measurement depicts the angle of the stem 140 from the vertical reference axis of about 131 degrees which measures the angle between the reflector top 132 and stem 140. The angle $\theta$ is shown as about 41 degrees. An angle of the lamp assembly 152 is also measured from the reference horizontal axis. The angle $\alpha$ is about 21 degrees. Accordingly, the angle between the lamp and a vertical reference is about 69 degrees. Finally, an angle is also measured between the stem 140 and the lamp assembly 152 which is about 20 degrees.

The foregoing description of an embodiment has been presented for purposes of illustration. It is not intended to be exhaustive or to limit the invention to the precise forms disclosed, and many modifications and variations are possible in light of the above teaching. It is intended that the scope of the invention be defined by the claims appended hereto.

What is claimed is:

1. A low-bay luminaire, comprising:

a reflector having a first smaller opening at an upper end and a second larger opening at a lower end;

a ballast housing disposed above the smaller opening;

a stem positioned beneath said ballast housing extending from near said ballast housing downward and radially outward;

a socket disposed near a radially outward end of said stem;

a compact fluorescent lamp having a base for electrical connection at a single end, said base engaging said socket;

said compact fluorescent lamp configured in a base down diagonal orientation wherein said lamp extends from said base upwardly toward a luminaire center.

2. The low-bay luminaire of claim 1 further comprising a reflector plate disposed within said reflector.

3. The low-bay luminaire of claim 2, said stem connected to said reflector plate.

4. The low-bay luminaire of claim 1 further comprising a ballast within said ballast housing.

5. The low-bay luminaire of claim 4 further comprising wiring between said ballast and said socket.

6. The low-bay luminaire of claim 1 wherein said reflector is bell-shaped.

7. The low-bay luminaire of claim 1 further comprising a wire-grid extending across said second lower opening.

8. The low-bay luminaire of claim 1 further comprising a lens disposed over said second larger opening at said lower end.

9. The low-bay luminaire of claim 8 wherein said lens is connected to said reflector along a lower edge of said reflector and an upper edge of said lens.

10. The low-bay luminaire of claim 8 wherein said lens is integrally formed with said reflector.

11. The low-bay luminaire of claim 8 further comprising a wire-grid extending over said lens.

12. The low-bay luminaire of claim 1 wherein said lamp extends diagonally upward and radially inward.

13. The low-bay luminaire of claim 1 wherein said lamp is rotated at an angle from a radially extending axis.

14. A luminaire, comprising:

an upper enclosure portion;

a reflector connected to said upper enclosure portion;

a stem extending radially outwardly and downwardly within said reflector from an upper support structure;

a socket connected to said stem;

a lamp assembly connected to said socket, said lamp assembly having a base and a lamp;

said base positioned radially outwardly and downwardly adjacent an end of said stem so that said lamp extends upwardly and radially inwardly from said base.

15. The luminaire of claim 14, said reflector being acrylic.

16. The luminaire of claim 15, said reflector being polished aluminum.

17. The luminaire of claim 14 wherein said lamp is angled at a range of about 20 to 30 degrees from a horizontal plane.

18. The luminaire of claim 14, said lamp having electrical connection at a single end.

19. A luminaire optical system, comprising:

a ballast housing;

a reflector having an upper end and a lower end, said ballast housing connected to said reflector;

a plurality of lamp assemblies each having a base and a lamp portion, said lamp portion in electrical communication with said base at a single end;

said base disposed downward and radially outward of said lamp portion and said lamp portion extending upwardly from said base.

20. The luminaire optical system of claim 19 further comprising a stem extending downward and radially outward to a lowermost end of said lamp assembly.

21. The luminaire optical system of claim 20 further comprising a socket positioned at a lower end of said stem.

22. The luminaire optical system of claim 21, said lamp assembly connected to said socket.

23. The luminaire optical system of claim 19, said lamp assemblies being rotated from radially extending reference axes.

24. A luminaire optical system, comprising:

a reflector having a plurality of lamp assemblies arranged therein;

said lamp assemblies spaced apart circumferentially;

said lamp assemblies each having a base and a lamp extending from said base;

a socket in electrical communication with each of said lamp assemblies;

each of lamp assemblies having a base down arrangement such that each lamp extends upwardly and inwardly within said reflector.

25. The luminaire optical system of claim 24 further comprising a ballast housing connected to said reflector.

26. The luminaire optical system of claim 24 further comprising a reflector plate within said reflector and a plurality of stems depending from said reflector plate.

27. The luminaire optical system of claim 26 said sockets receiving said lamp assemblies.

28. The luminaire optical system of claim 26, said stems extending downwardly and radially outward.

29. The luminaire optical system of claim 24 further comprising a ballast plate disposed within said ballast housing.

30. The luminaire optical system of claim 24, said lamp assemblies having a single electrical connection at one end of said assembly.

31. The luminaire optical system of claim 24, said lamp assemblies extending upwardly toward said reflector plate.

32. A luminaire optical system, comprising:

a ballast housing connected to a reflector;

a reflector plate positioned in an upper portion of said reflector;

a plurality of stems extending downward and radially outward from said reflector plate;

a plurality of lamp assemblies each having a single electrical connection;

each of said lamp assemblies connected to a lower end of each of said stems, said lamp assemblies extending upwardly and radially inward toward said reflector plate.

33. The luminaire optical system of claim 32, said ballast housing having at least one upper vent aperture and at least one lower vent aperture.

34. The luminaire optical system of claim 32, said lamp assemblies being circumferentially spaced apart.

* * * * *